US008528882B2

(12) United States Patent
Pensa

(10) Patent No.: US 8,528,882 B2
(45) Date of Patent: Sep. 10, 2013

(54) WATER CARBONATOR WITH PLASTIC END PLATES

(75) Inventor: Carlo Maria Pensa, Esino Lario (IT)

(73) Assignee: O. D. L. SRL, Lierna (IT)

( * ) Notice: Subject to any disclaimer, the term of this patent is extended or adjusted under 35 U.S.C. 154(b) by 314 days.

(21) Appl. No.: 12/922,972

(22) PCT Filed: Mar. 9, 2009

(86) PCT No.: PCT/EP2009/001763

§ 371 (c)(1),
(2), (4) Date: Sep. 16, 2010

(87) PCT Pub. No.: WO2009/115225

PCT Pub. Date: Sep. 24, 2009

(65) Prior Publication Data

US 2011/0042834 A1 Feb. 24, 2011

(30) Foreign Application Priority Data

Mar. 17, 2008 (IT) ..... MI2008A0441

(51) Int. Cl.
*B01F 3/04* (2006.01)

(52) U.S. Cl.
USPC ..... 261/74; 261/DIG. 7; 220/613; 220/614

(58) Field of Classification Search
USPC ..... 261/50.3, 53, 59, 74, 121.1, DIG. 7; 220/611, 613, 614
See application file for complete search history.

(56) References Cited

U.S. PATENT DOCUMENTS

| | | | | |
|---|---|---|---|---|
| 2,826,401 | A | 3/1958 | Peters | |
| 2,957,734 | A | 10/1960 | McLeod | |
| 3,068,312 | A | 12/1962 | Daley et al. | |
| 3,069,489 | A | 12/1962 | Carmichael et al. | |
| 4,518,541 | A * | 5/1985 | Harris | 261/27 |
| 4,854,343 | A * | 8/1989 | Rilett | 137/543.19 |
| 5,191,775 | A | 3/1993 | Shiina et al. | |
| 5,606,864 | A * | 3/1997 | Jones | 62/139 |
| 5,979,694 | A | 11/1999 | Bennett et al. | |
| 6,182,949 | B1 * | 2/2001 | Mobbs | 261/34.1 |
| 6,453,697 | B1 | 9/2002 | Harmer et al. | |

FOREIGN PATENT DOCUMENTS

WO 2007/022882 3/2007

* cited by examiner

*Primary Examiner* — Charles Bushey
(74) *Attorney, Agent, or Firm* — Dilworth & Barrese, LLP.

(57) ABSTRACT

A water carbonator has a tubular body (1) closed at the ends by a pair of end plates (2, 4) preset for the hydraulic circuit for mixing water with $CO_2$. These end plates (2, 4) are secured to the tubular body (1) by a shape coupling. Sealing of pressure of the fluid contained in the tubular body (1) is ensured by interposing elastic gaskets (3, 18).

12 Claims, 2 Drawing Sheets

SEZ.: A–A

SEZ.: B–B

SEZ.: C–C

WATER CARBONATOR WITH PLASTIC END PLATES

BACKGROUND OF THE INVENTION

The present invention relates to a water carbonator comprising a tubular container shaped such that it holds the plastic end plates without using any additional mechanical fastenings.

The water carbonators are well known apparatuses that serve to add carbon dioxide ratios to the water contained therein in order to thus obtain sparkling water, also commonly known as soda. They are substantially constituted by a container in which suitable passageways are formed such that there will be a $CO_2$ inlet, a water inlet, a sparkling water outlet and suitable instruments for checking water level. A relief valve, due to the characteristics of pressurized tank with gas presence, is provided as well. The operation typically occurs by filling the container up with $CO_2$ having a pressure ranging between 3 and 7 bars, then by letting the water entering, pushed by a higher pressure pump, through an orifice such that it is nebulized in the form of micro drops that offer a wide exchange surface and therefore gas absorption, the water having, due to Bernoulli effect, high speed. Suitable construction expedients, such as rebounding plates or tubes with holes at the nozzle level and particular profile at the end, are often inserted to raise to the most the water gassing.

The water level within the carbonator is kept such that in the upper portion there is always a $CO_2$ amount. In order to obtain that result different systems are used: the most used system provide feelers that allow for detecting the presence of water between the feeler tip and the wall or other element connectable to an electronic system. They can be formed with one or two feelers. In the embodiment with two feelers, as the drawn water causes the level to fall below the longest feeler, the electronic system, which detects the dielectric between feeler and wall, actuates the pump operating till the level reaches the shortest feeler; in the embodiment provided with only one feeler, typical for carbonators having small capacity, some delays in the pump starting and stopping are added such that there is no instability due to the wave therein generated.

In the more common configuration the carbonators are formed with stainless steel having the pipe fittings, even formed with stainless steel, welded: from a technical standpoint this is the best solution but it has high manufacturing cost and the pipe fitting size is noticeable.

Alternative solutions were therefore studied having plastic parts which allow for forming the inlet and outlet passageways more easily and in a cost-effective manner.

The currently adopted solutions provide for making the container with a steel tube and a pair of head, also called end plates, of plastic material and held by tie rods that can be inside or outside the tube. The cheapest solution has just one central tie rod which holds both plates, but it is a solution having crack failure risk: two tie rods would assure of more reliability but would increase cost.

SUMMARY OF THE INVENTION

The solution provided for the carbonator according to the present invention fully overcomes the problem in a particularly cheap manner and provides that the same outer envelope holds the two end plates.

BRIEF DESCRIPTION OF THE DRAWINGS

A detailed description of some preferred embodiments according to the invention will be now provided with reference to the annexed drawings, in which.

DESCRIPTION OF THE PREFERRED EMBODIMENTS

Figure 2:
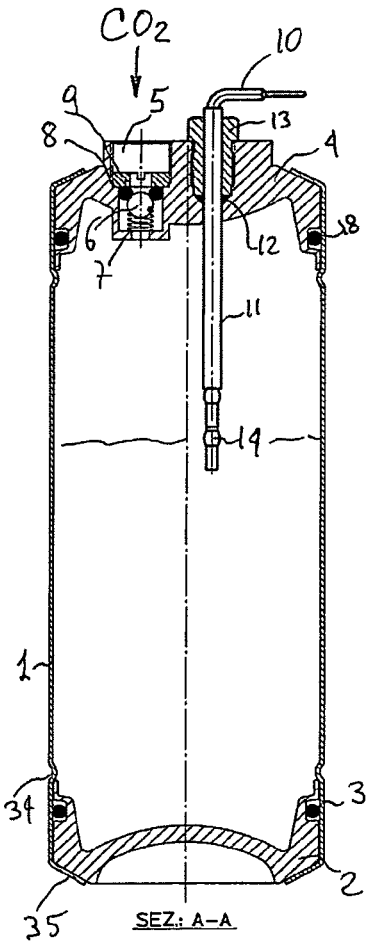
FIG. 2 is a first cross-sectional view taken along line A-A in FIG. 1.

Referring now to FIG. 2, there are illustrated a container tube 1, the bottom end plate 2 which seals the tube 1 by the gasket 3; the top end plate 4, where there are formed the inlet and outlet passageways, the level check and the relief valve; the sealing of the tube 1 is assured by the gasket 18. There is then shown the $CO_2$ inlet 5; a nonreturn valve is inserted into the line and it is constituted by a ball 6 pushed by a spring 7 which seals against a gasket 8 held in seat by a ring nut 9. In a head 4 there is a seat for a feeler 10 covered by a sheath 11 and provided with a level sensor 14; the sealing is assured by a gasket 12 pushed to lock the feeler 10 by means of a ring nut 13 such that the level of the feeler 10 can also be adjustable.

Figure 3:
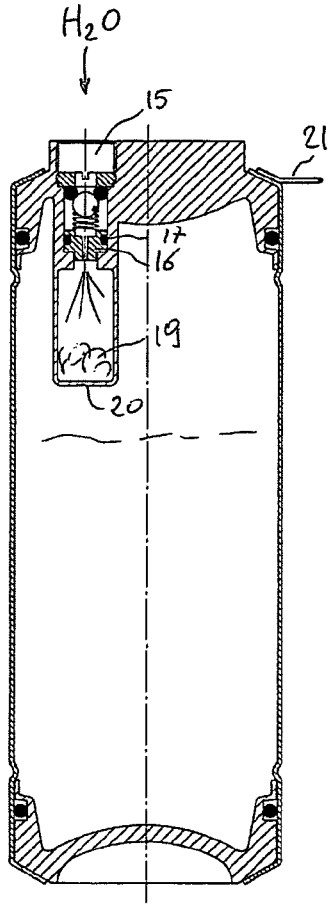
FIG. 3 is a second cross-sectional view taken along line B-B in FIG. 1.

FIG. 3 shows section corresponding to the water inlet 15, connected to an outer pump (not shown): besides a nonreturn valve like the one at $CO_2$ inlet there is the presence of a nozzle 16, suitably shaped and sealing by means of a gasket 17, sprinkling water in a chamber 19 with rebounding effect onto the underlying wall 20. It is further indicated the ground contact 21 of the envelope.

Figure 4:
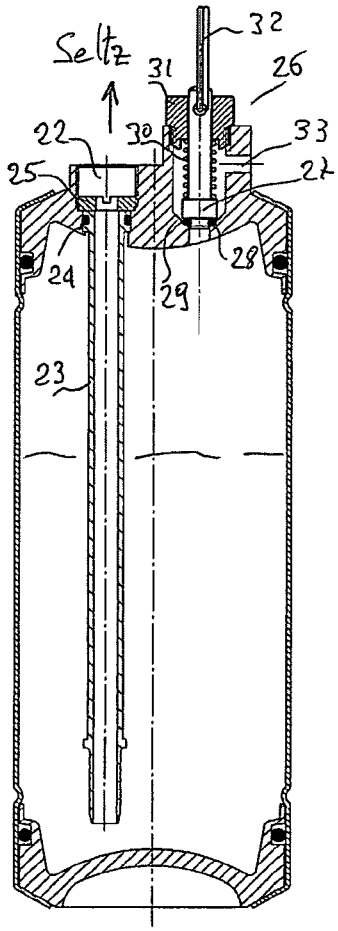
FIG. 4 is a third cross-sectional view taken along line C-C in FIG. 1.

FIG. 4 shows the section corresponding to the soda outlet and the relief valve: there is indicated the outlet pipe fitting 22, which will be connected to the pouring tap and where comes the suction tube 23 sealing by means of a gasket 24 and held in seat by a ring nut 25. A relief valve 26 is constituted by a rod 27, with a gasket 28, pushed against the seat 29 by a spring 30 clashed by a ring nut 31; a ring 32 allows for manually leaking the carbonator trough a conduit 33. Even through said conduit 33 there will occur the vent as the pressure inside the carbonator will overcome the calibration value of said relief valve.

Figure 1:
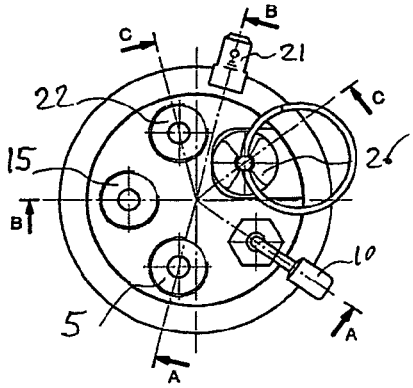
FIG. 1 is a top view of a first preferred embodiment according to the present invention.

In such carbonator the end plates 2 and 4 are held by the tube 1 by means of a permanent set thereof achieved by a pair of rollings which facilitate noticeably the assembly process: in FIG. 1 there is indicate a channel 34 against which abuts said end plate 2 which is in turn blocked by a riveting 35 of the tube 1 achieved by rolling or forming. Without limiting in any way the invention the rolling along the channel 34 can be replaced by notches achieved by forming.

Figure 5:
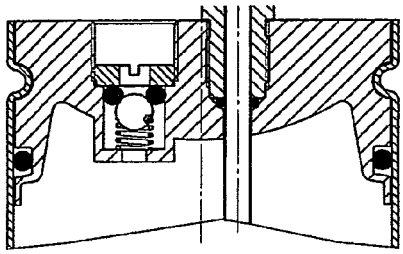
FIG. 5 is a partial cross-sectional view of a second preferred embodiment according to the present invention.

FIG. 5 shows a solution providing a single rolling or notches achieved by forming.

Figure 6:
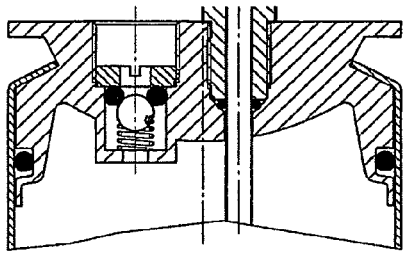
FIG. 6 is a partial cross-sectional view of a third preferred embodiment according to the present invention.

FIG. 6 shows a rolling solution which allows for achieving the end plate fastening in only one step.

Figure 7:
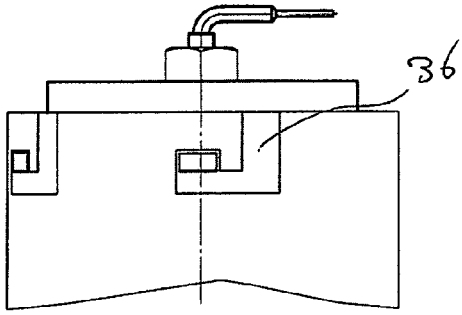
FIG. 7 is a partial view of a fourth preferred embodiment according to the present invention.
Figure 8:
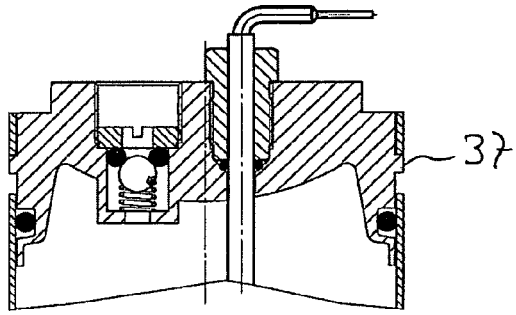
FIG. 8 is a cross-sectional view of the embodiment in FIG. 7.

FIGS. 7 and 8 show a possible solution providing a bayonet mounting wherein openings 36 are formed into the tube 1 and the corresponding mount teeth 37 onto the end plates along with different expedients for locking them once mounted.

The invention claimed is:

1. A water carbonator comprising:

(i) a tubular body (1) formed by metal material having two open ends, (ii) a pair of closure elements (2, 4) formed by plastic material for said tubular body (1), wherein at least one (4) of said closure elements (2, 4) comprises inlets (5, 15) for fluids to be mixed and at least one outlet (22) for the mixed fluid, said closure elements (2, 4) are each fitted between and supported by a radially rolled free end portion (35) of said tubular body (1) and an inwardly bent channel portion (34) of said tubular body (1) and rolled onto said closure elements (2, 4), each closure element (2, 4) partially protruding from said respective open end, and a central portion of one of said closure elements (2, 4) comprises said inlets (5, 15) and at least one outlet (22) and protrudes from said respective open end.

2. The water carbonator according to claim 1, wherein said closure elements are provided with at least one outer groove housing sealing gaskets.

3. The water carbonator according to claim 1, additionally comprising a non-return valve inserted into one (5) of said inlets (5, 15) and formed by a ball (6) pushed by a spring (7) to seal against a gasket (8) held in a seat by a ring nut (9).

4. The water carbonator according to claim 2, additionally comprising ring gaskets (18, 3) sealing said tube (1) and respective closure elements (2, 4).

5. The water carbonator according to claim 4, wherein said closure elements (2, 4) comprise grooves for receiving said respective ring gaskets (18, 3).

6. The water carbonator according to claim 1, wherein one (4) of said closure elements (2, 4) comprises a seat, and additionally comprising a feeler (10) covered by a sheath (11) and provided with a level sensor (14) at an end thereof.

7. The water carbonator according to claim 6, additionally comprising a gasket (12) arranged to at a bottom of the seat and a ring nut (13) surrounding the feeler (10), such that sealing is attained by pushing the ring nut (13) on the gasket (12) while level of the feeler (10) is adjustable.

8. The water carbonator according to claim 1, additionally comprising a nozzle (16) mounted in one (15) of said inlets (5, 15), a gasket (17) arranged to seal the nozzle (16) against said closure element (4), and a chamber (19) mounted upon said closure element (4) within said tubular body (1) to surround said nozzle (16), such that water sprayed into said tubular body (1) rebounds off an underlying wall (20) of said chamber (19) positioned opposite an exit of said nozzle (16).

9. The water carbonator according to claim 1, additionally comprising a pipe fitting (22) situated within said outlet (22) for carbonated fluid in one (4) of said covers (2, 4), a suction tube (23) extending from said pipe fitting (22) into said tubular body (1), and a gasket (24) arranged to seat between said suction tube (23) and cover (2) and ring nut (25) arranged to retain said gasket (24) against said cover (2) to seal said suction tube (23) against said cover (2).

10. The water carbonator according to claim 1, additionally comprising a relief valve (26), an opening in one (4) of said covers (2, 4) having a seat (29) for said relief valve (26), said relief valve (26) comprising a rod (27) positioned in the opening of said cover (4), a gasket (28) arranged to be positioned in said seat (29), a spring (30) arranged to push said gasket (28) against said seat (29), a conduit (33) extending from said relief valve (26), a first ring nut (31) arranged to press said spring (30) against said gasket (28), and a second ring nut (32) arranged to allow leaking or venting of fluid through said conduit (33).

11. The water carbonator according to claim 1, wherein said channel (34) is arranged to abut one (2) of said covers (2, 4), and a riveting (35) is arranged to block said cover (2) abutting said channel (34).

12. The water carbonator according to claim 1, additionally comprising a ground contact (21) extending from an end of said tubular body (1).

* * * * *